US005412883A

United States Patent [19]

Wulf et al.

[11] Patent Number: 5,412,883

[45] Date of Patent: May 9, 1995

[54] SKI BOOT AND SKI BOOT-BINDINGS

[76] Inventors: Elmer B. Wulf, 1907 Jasmine, Denton, Tex. 76205; Mark E. Wulf, 24447 Blvd. DeJohn, Naperville, Ill. 60564

[21] Appl. No.: 89,841

[22] Filed: Jul. 12, 1993

[51] Int. Cl.[6] ..... A43B 5/04

[52] U.S. Cl. ..... 36/50.5; 36/117; 36/121; 280/613

[58] Field of Search ..... 36/50.5, 117, 121, 120; 280/613

[56] References Cited

U.S. PATENT DOCUMENTS

| | | | |
|---|---|---|---|
| 3,718,995 | 3/1973 | Graup | 36/121 |
| 4,085,528 | 4/1978 | Delery | 36/121 |
| 4,539,764 | 9/1985 | Pradier | 36/121 |
| 4,601,118 | 7/1986 | Zanatta | 36/121 X |
| 4,631,839 | 12/1986 | Bonetti et al. | 36/50.5 |
| 4,633,599 | 1/1987 | Morell et al. | 36/50.5 X |
| 4,670,999 | 6/1987 | Olivieri | 36/50.5 X |
| 4,691,454 | 9/1987 | Ottieri | 36/120 X |
| 4,757,621 | 7/1988 | Iwama | 36/119 |
| 4,765,069 | 8/1988 | Baggio et al. | 36/50.5 X |
| 4,880,251 | 11/1989 | Wulf et al. | 36/117 |
| 4,984,375 | 1/1991 | Bonnet | 36/119 |
| 5,012,598 | 5/1991 | Baggio et al. | 36/50.5 X |
| 5,020,822 | 6/1991 | Wulf et al. | 36/117 |
| 5,026,087 | 6/1991 | Wulf et al. | 36/117 |
| 5,287,639 | 2/1994 | Tonel | 36/117 |

FOREIGN PATENT DOCUMENTS 1193946 11/1959 France .

*Primary Examiner*—Paul T. Sewell
*Assistant Examiner*—Ted Kavanaugh
*Attorney, Agent, or Firm*—Lee, Mann, Smith, McWilliams, Sweeney & Ohlson

[57] ABSTRACT

A ski boot and a combination of a ski boot and a releasable ski binding which attaches the boot to a ski. The boot includes a forward cuff and a hinged rear cuff, the rear cuff being secured to the forward cuff such that upon predetermined rearwardly-directed load, the rear cuff separates from the forward cuff to permit free movement of the rear cuff. A closure is provided for engaging the rear cuff with the forward cuff. The binding includes a first connecting portion secured to the ski and a second connecting portion secured to the ski boot. The two portions are releasably coupled so that they can be disengaged under predetermined load. A cam arrangement extends from the rear cuff of the boot in order to engage the first connecting portion to cause uncoupling of the first and second connecting portions upon separation of the rear cuff from the forward cuff. For retaining a foot in place, the boot includes a foot-enveloping foot positioning device, preferably connected to the front closure by a pair of cables. The closure is adjustable for proper location of the foot positioning device and proper closure of the rear cuff. The boot can be canted relative to the ski by tilting part of the first connecting portion of the binding.

20 Claims, 10 Drawing Sheets

Fig. 2
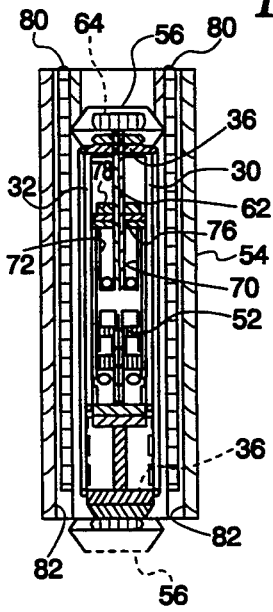
Fig. 1
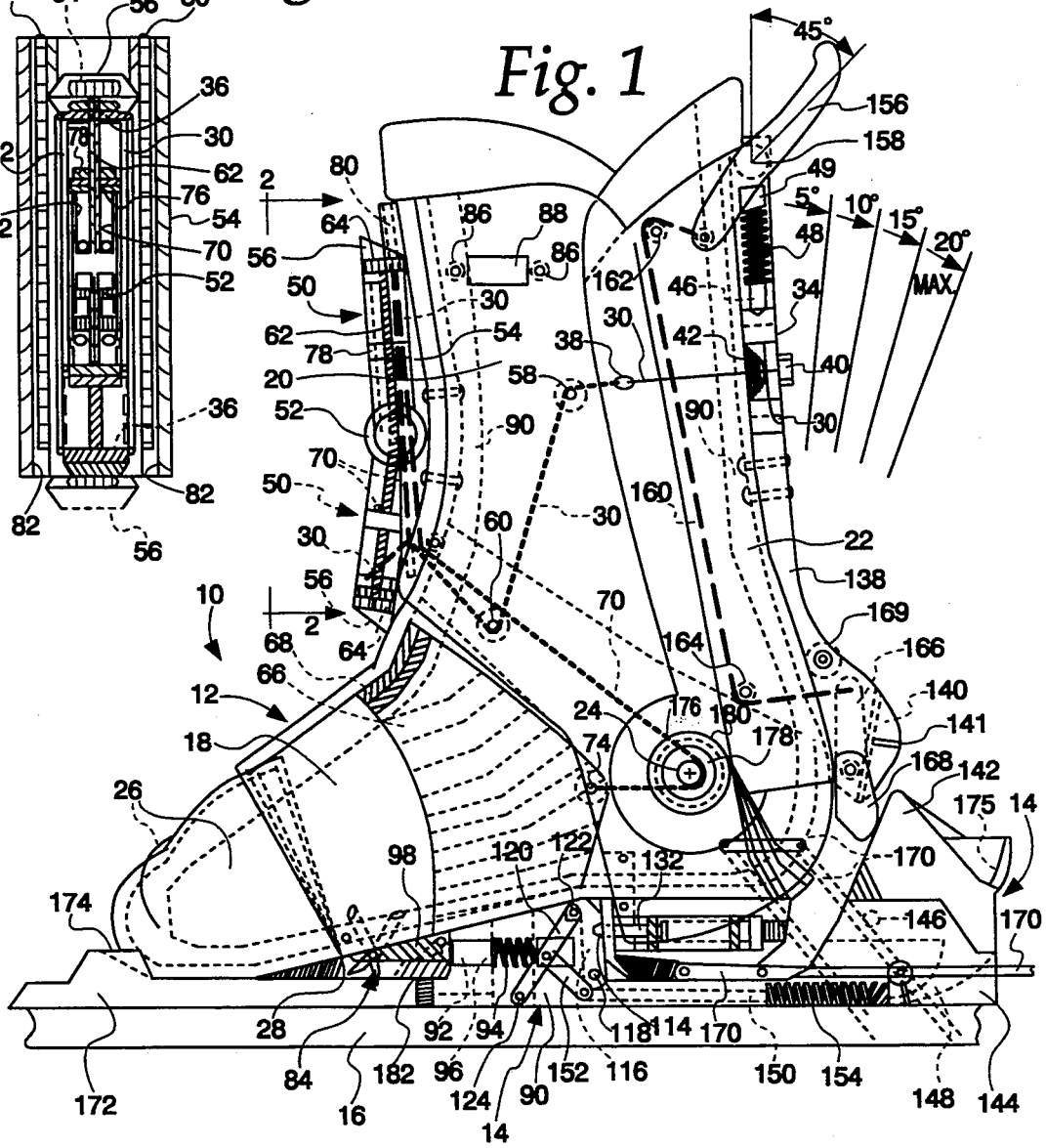
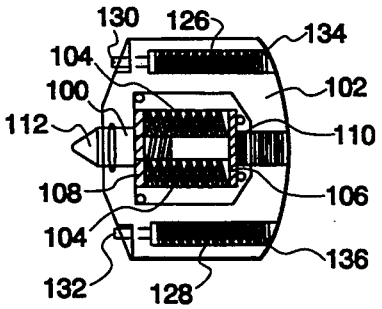
Fig. 3

SKI BOOT AND SKI BOOT-BINDINGS

BACKGROUND OF THE INVENTION

This invention relates to ski boots and ski bindings, and in particular to a unique ski boot and an operative combination of a ski boot and a binding. The invention permits both uncoupling of the boot from the binding upon release of the rear cuff of the ski boot, and also uncoupling if the skier is facing injury, but the rear cuff has not released.

This invention is an improvement over the applicants' ski boot and ski boot-binding described in U.S. Pat. Nos. 4,880,251, 5,020,822 and 5,026,087, the disclosures of all of which are incorporated herein by reference. While the inventions disclosed in such patents are vast improvements over conventional ski boots and boot-binding combinations, the present invention provides even greater safety and comfort for a skier.

As the technology relating to skis and ski boots has advanced over the years, leg injuries, particularly ankle injuries, have been reduced dramatically. However, knee injuries have actually dramatically increased. The vast majority of all skiing combinations still comprise a ski boot and a binding mounted on the ski. Rarely is any portion of the binding actually incorporated in the ski boot. While the number of manufacturers of skis, boots and bindings has decreased over the years, and while more manufacturers are becoming involved in all three areas, skis, boots and bindings are still being manufactured as individually separate systems. Radical advances in skiing safety by permitting the integration of skis, boots and bindings, or at least the boots and bindings, have not occurred. While bindings have experienced minor advances over the years, the typical binding still clings to the decades old structure of a toe portion and a heel portion, which clamp respectively to the skier's boot toe and boot heel. Because the typical boot sole is quite long, clamping at these great lengths necessitates a rather long lever arm for release. If the release settings for the binding are even a bit too tight, the long lever arm can easily result in injury to the skier.

U.S. Pat. No. 3,917,732 describes a basic and welcomed improvement in ski bindings, where the lever arm of the binding is considerably reduced. The commercial form of the device of this patent resulted in a binding still separate from the boot, necessitating an additional plate and additional weight. While the concepts behind the invention of this patent considerably improve upon the conventional heel and toe bindings, it has not proven to be a perfect answer to the problems encountered with heel and toe bindings.

Most conventional ski boots of the clam shell type (having forward and rear cuffs) have only limited lean adjustment in the forward direction and none rearward when the ski boot is closed for skiing. In this type of ski boot, and in all other modern, stiff ski boots, ankle injuries have been largely eliminated, but the stiffness of the boot and the inability to bend rearwardly have created new knee problems, and in particular tears of the anterior cruciate ligaments. This type of injury can often end a skier's skiing career, or force the truly avid skier to wear a knee brace in order to be able to ski in the future.

The three incorporated patents provide many operative improvements for both a ski boot and also the combination of a ski boot and releasable ski binding. The present invention provides additional improvements in both the boot and the boot-binding combination, providing an integrated structure having reliable release characteristics, injury protection, and further protection against phantom foot injury, another knee injury occurring generally when the skier is crouched, allowing substantial compressive torque of the body about the knee.

SUMMARY OF THE INVENTION

The invention pertains to both a ski boot and a combined ski boot and binding for releasably attaching the ski boot to a ski. The boot comprises a foot shell shaped to encompass at least a portion of a foot when the ski boot is worn. A forward cuff and a hinged rear cuff are attached to the foot shell. Means is provided for releasably securing the rear cuff to the forward cuff, and including means responsive to rearward pressure on the rear cuff for releasing the rear cuff so that under predetermined rearwardly-directed load on the rear cuff the rear cuff will separate from the forward cuff to permit free movement of the rear cuff. Closing means is provided, mounted on the forward cuff, and being positionable in a first orientation for engaging the rear cuff with the forward cuff and being positionable in a second orientation to disengage the rear cuff from the forward cuff.

For releasably securing the rear cuff to the forward cuff, at least one, and preferably two, cables are connected to the closing means. The means responsive to rearward pressure on the rear cuff for releasing the rear cuff comprises a cable end grip and a spring-loaded plunger engaging the cable end grip. The cable end grip preferably comprises a rotatable hub having at least one circumferential notch therein, with the plunger engaging that notch. Means is provided for automatically reengaging the plunger and the notch when disengaged. Preferably, a recoil spring is secured to the hub to provide the automatic reengagement.

The means for closing the two cuffs preferably comprises a pivotal closure lever. Means is provided for adjusting attachment of the cables to the closure lever. That means comprises a cable clamp mounted for axial advancement on a guide in the closure lever.

For proper positioning of the foot in the ski boot, the invention includes a foot-enveloping foot positioning device, along with means for adjusting the location of the foot positioning device in the boot. This means for adjustment comprises a pair of cables attached to opposite sides of the foot positioning device and connected to the closure lever for drawing the foot positioning device toward the heel of the ski boot when the closure is closed to join the two cuffs into the first orientation.

Forward flexure of the forward cuff is controlled by the invention. A reinforcement member is provided extending along a forward face of the forward cuff, the reinforcement member having at least one longitudinal bore therein. A flex control rod is inserted in the bore to control the forward flex.

The binding portion of the invention includes a first connecting means secured to the ski and a second connecting means secured to the ski boot. Means is provided for releasably coupling the first and second connecting means so that the connecting means may be disengaged in the forward, backward or lateral directions, or a combination thereof, under predetermined load conditions. Means is provided extending from the rear cuff of the boot for engaging the first connecting means to cause uncoupling of the first and second connecting means upon separation of the rear cuff from the forward cuff.

Preferably, the means extending from the rear cuff comprises a cam and the invention includes a cam surface in the binding in registration with the cam. In accordance with one form of the invention, a link is included extending between the cam surface and first connecting means. The first connecting means includes a socket and the second connecting means includes a plunger engaged in the socket. The socket is in a socket member which is hinged for pivotal movement away from the plunger.

In the preferred form of the invention, means is provided for maintaining the socket in engagement with the plunger. That means comprises a toggle, with the link being connected to the toggle to engage the toggle under release conditions in order to pivot the toggle to permit the socket member to rotate.

Preferably, a second means is provided for causing uncoupling of the first and second connecting means without separation of the rear cuff from the forward cuff. A pivotal cam is provided in registration with the cam surface, and an initiation paddle, secured to the top of the rear cuff, is connected to the pivotal cam for rotation thereof. When the paddle is activated, the pivotal cam pivots, striking the cam surface and causing immediate uncoupling of the first and second connecting means by pivoting the socket member out of engagement with the plunger.

Means is provided for canting the ski boot relative to the ski. That means comprises at least one lateral base plate in the first connecting means of the binding and located beneath the ski boot, and including means for tilting the base plate which comprises a pair of spaced cams, one cam being in registration with one end of the base plate and the other being in registration with the other end of the base plate. Means is provided for adjusting the cams to raise one end of the base plate and lower the other end of the base plate, that means comprising a rack extending from each cam and a pinion engaged on each rack, the pinions being rotated in opposite relative directions to translate the cams in opposite directions and therefore raise and lower the opposite ends of the base plate to cant the base plate and therefore cant the boot relative to the ski. Preferably, a pair of base plates is employed, and separate means is provided for tilting each of the base plates.

BRIEF DESCRIPTION OF THE DRAWINGS

The invention is described in greater detail in the following description of examples embodying the best mode of the invention, taken in conjunction with the drawing figures, in which:

FIG. 1 is a side elevational illustration of one form of a ski boot and the combination of a ski boot and ski binding according to the invention, FIG. 2 is a front elevational illustration taken along lines 2—2 of FIG. 1 showing the pivotal closure lever, FIG. 3 is a cross-sectional view of the heel of the boot of FIG. 1, showing detail.

DESCRIPTION OF EXAMPLES EMBODYING THE BEST MODE OF THE INVENTION

Figure 4:
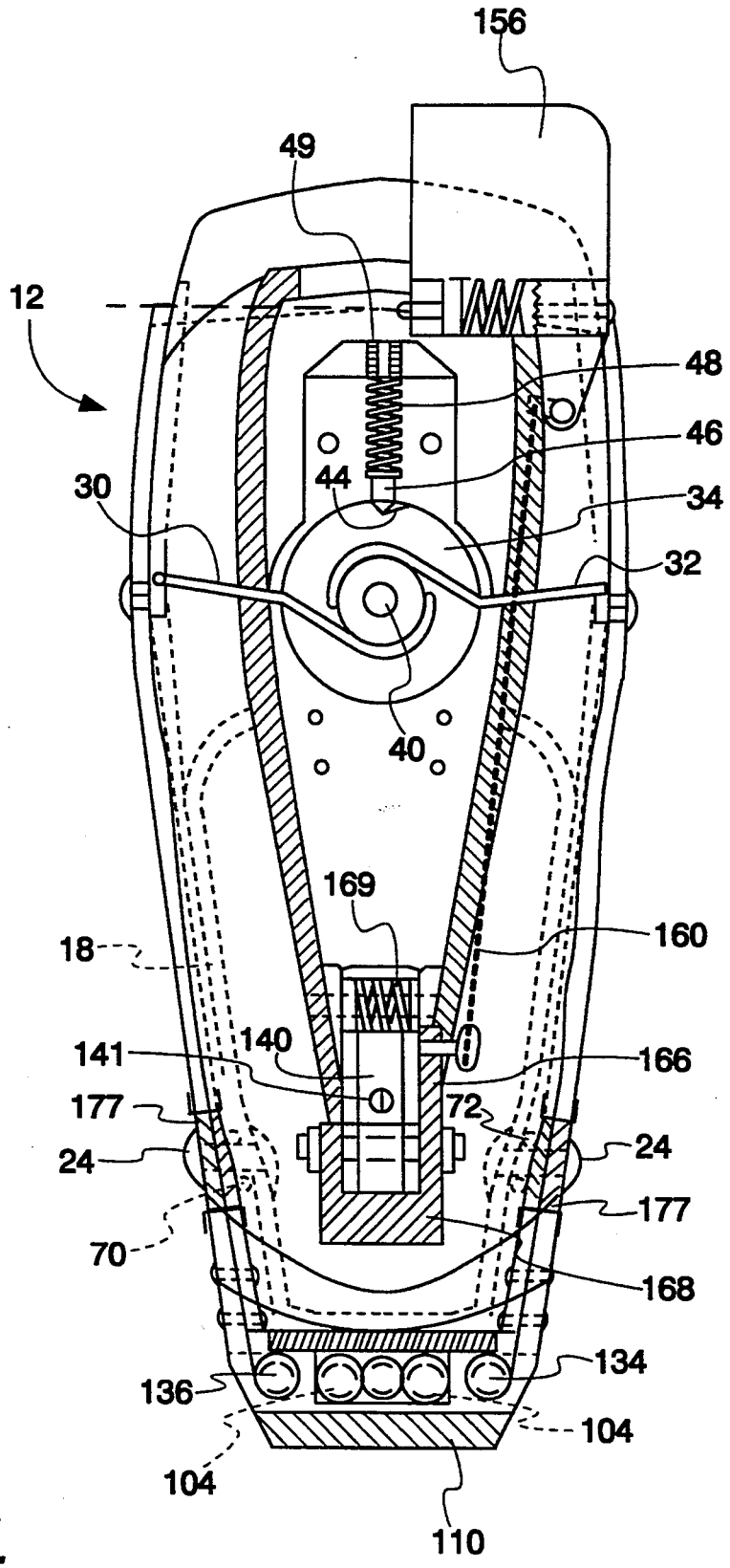
FIG. 4 is a rear elevational view of the ski boot of FIG. 1, with portions removed for purposes of clarity and explanation.

Turning first to FIGS. 1–4, a ski boot and integral binding according to the invention is shown generally at 10. It is comprised of two basic portions, a ski boot 12 and a binding 14 which is partially incorporated into the ski boot 12 and partially secured to a ski 16, as will become evident from the following description of both the ski boot 12 and the binding 14.

The ski boot 12 is of the clam shell type, having a foot shell 18 and a forward cuff 20 and a rear cuff 22 which pivot and are joined about a central pivot 24 located on opposite sides of the ski boot 12. The forward cuff 20 overlies the rear cuff 22, with the portion of the rear cuff 22 beneath the forward cuff 20 being shown in phantom in FIG. 1.

Figure 5A:
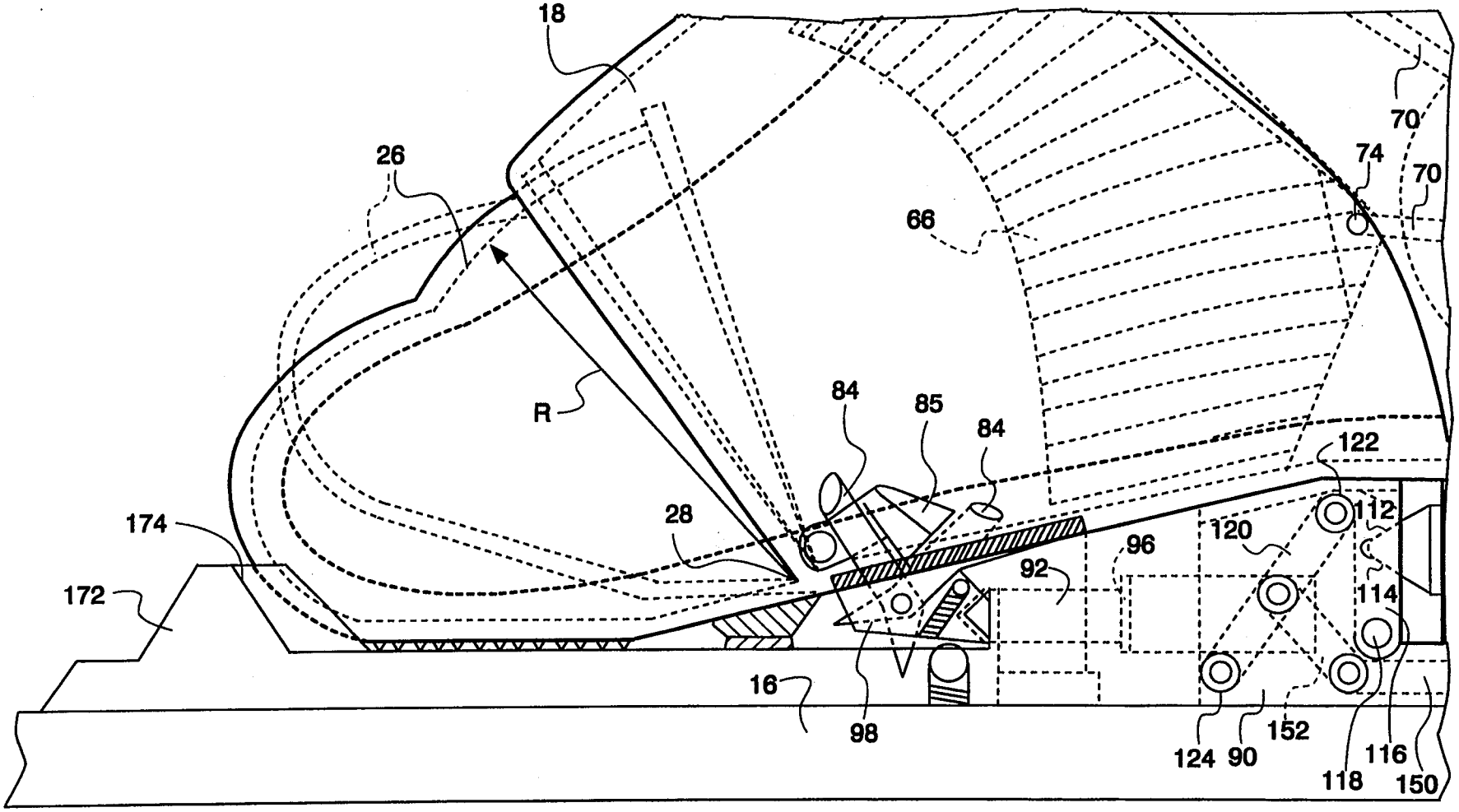
FIGS. 5A and 5B are enlarged views of the toe and heel portions of the boot of FIG. 1 to illustrate additional detail.

A toe segment 26 extends from the foot shell 18. The foot shell 18 overlaps the toe segment 26 as illustrated in FIG. 1, joining at a living hinge 28 formed in the boot 12 at approximately the location of the ball of the foot when within the boot. The hinge 28 aids a skier tremendously while walking in the ski boot 12, since the typical ski boot has a rigid sole, thus having a focal point at the toe when walking, rather than at the ball of the foot. The ski boot according to the invention pivots about the living hinge 28, and therefore does not suffer that deficiency. The toe segment 26 is curved with a radius R as illustrated in FIG. 5A so that, when pivoting about the living hinge 28, the toe segment 26 and foot shell 18 form a water tight seal without inhibiting pivoting about the living hinge.

The cuffs 20 and 22 are joined by cables 30 and 32 on opposite sides thereof. The cables 30 and 32 are affixed or gripped at one end in a rotatable hub 34. At their opposite ends, the cables 30 and 32 are connected to a cable clamp 36 forming part of a closure lever. The cables 30 and 32 may be located wholly within the material of the boot 12, or can pass exteriorly of the boot 12 for certain portions thereof, such as the cable 30 passing through an eye 38 as shown in FIG. 1. The cable 32 would be directed similarly.

The hub 34 is affixed to the rear cuff 22 by a central bolt 40 or similar means. For automatically returning the hub 34 to a desired location, a recoil spring 42 is mounted about the bolt 40 and is appropriately secured to the hub 34 in a conventional fashion.

The hub 34 includes at least one notch 44. A plunger 46 engages the notch 44, being biased toward the notch 44 by a retention spring 48. Tension of the spring 48 is controlled by a screw tension control 49 in a conventional manner. Thus, the plunger resists rotation of the hub 34 until the retention force of the spring 48 is overcome.

The cable clamp 36 is located in a closure lever 50. The lever 50 is mounted for rotation about a pivot 52 secured within a reinforcement member 54 extending along a forward face of the forward cuff 20. The lever 50 includes a finger grip 56 to permit pivoting of the lever 50 about the pivot 52 between an upper, closed orientation shown in bold in FIGS. 1 and 2, and a lower, opened orientation, shown in phantom in FIGS. 1 and 2.

Each of the cables 30 and 32 is guided in its path within the boot 12 by appropriate pins or roller guides, such as cable pulleys. For example, the cable 30 passes about two pulleys 58 and 60 in the forward cuff 20 before passing through an aperture in the forward cuff 20 to the closure lever 50.

When the closure lever 50 is in the upward, closed position, the cable 30 is drawn taut, and the rear cuff 22 is closed within the forward cuff 20 about a skier's leg (not illustrated) as shown in FIG. 1. In the lower, opened orientation, the closure lever 50 relaxes the cable 30, permitting the rear cuff 22 to open (toward the right in FIG. 1), permitting the skier to withdraw his foot from the boot 12. To adjust tension of the cable 30, the cable clamp 36 is mounted on a rotatable, threaded rod 62 in the closure lever 50. The rod 62 is rotated by a thumb screw 64. Rotation of the rod 62 causes the cable clamp 36 to advance axially along the threaded rod 62, thus permitting a great degree of latitude for changing the effective length of the cable 30 when the boot is closed, accommodating legs of different sizes of skiers wearing the boot 12.

Under normal load conditions, when the closure lever 50 is closed (in the upward orientation shown in FIGS. 1 and 2), the rear cuff 22 is engaged with the forward cuff 20. The plunger 46, biased by the spring 48, is engaged in the notch 44, and therefore the hub 34 is held in place. However, if rearward force exerted against the cuff 22 exceeds the holding force of the spring 48, the plunger 46 rises against the spring 48, allowing the hub 34 to rotate. Since the cables 30 and 32 are wrapped about the hub 34 (FIG. 4), rotation of the hub 34 permits the rear cuff 22 to open, to a maximum of about 20° as shown in FIG. 1.

In order for the rear cuff 22 to properly open when sufficient force is applied by the skier's leg to the cuff 22, it is important that the skier's foot be held firmly against the rear cuff 22. Thus, a foot enveloping foot position device 66 is located within the boot 12. The foot positioning device 66 surrounds the skier's foot when inserted within the boot 12, as explained in incorporated U.S. Pat. Nos. 5,020,822 and 5,026,087. The foot positioning device 66 comprises a flexible, thin body, preferably of plastic or the like, which surrounds the instep and arch of a foot inside the ski boot 12 when the ski boot is worn. The device 66 extends beneath the foot and on opposite sides of the foot, and includes a fastener 68 for fastening portions from opposite sides of the boot, and also for initial adjustment purposes. The fastener 68 may be an overlapping hook-and-loop fastener such as the well-known "Velcro"-type fastener.

For adjusting the location of the foot positioning device 66, a pair of cables 70 and 72 are attached to opposite sides of the foot positioning device 66, attachment of the cable 70 at an attachment point 74 being shown in FIG. 1, and the cable 72 being similarly attached. The cables 70 and 72 extend about the opposite central pivots 24, passing through the forward cuff 20 and being secured within a cable mount 76 secured on the threaded rod 62. The cable mount 76 includes a thumbscrew 78 threadedly secured on the threaded rod 62. Rotation of the thumbscrew 78 permits translation of the cable mount 76 along the threaded rod 62. Thus, the cable mount 76 may be positioned along the threaded rod 62 independently of the position of the cable clamp 36.

When the closure lever 50 is in the closed, upward position, the foot positioning device 66 is drawn rearwardly within the boot 12 by the cable 70. When the closure lever 50 is opened, however, the cable 70 is relaxed., and the foot positioning device 66 may move forwardly within the boot 12, permitting the skier to easily disengage his foot from the device 66.

As explained above, the closure lever 50 is mounted in the reinforcement member 54. The reinforcement member 54 stiffens the forward cuff 20, and may include one or more flex control rods 80 installed within longitudinal bores 82 located on opposite sides of the closure lever 50. Thus, great latitude for forward flex is afforded by the reinforcement member 54.

Figure 5B:
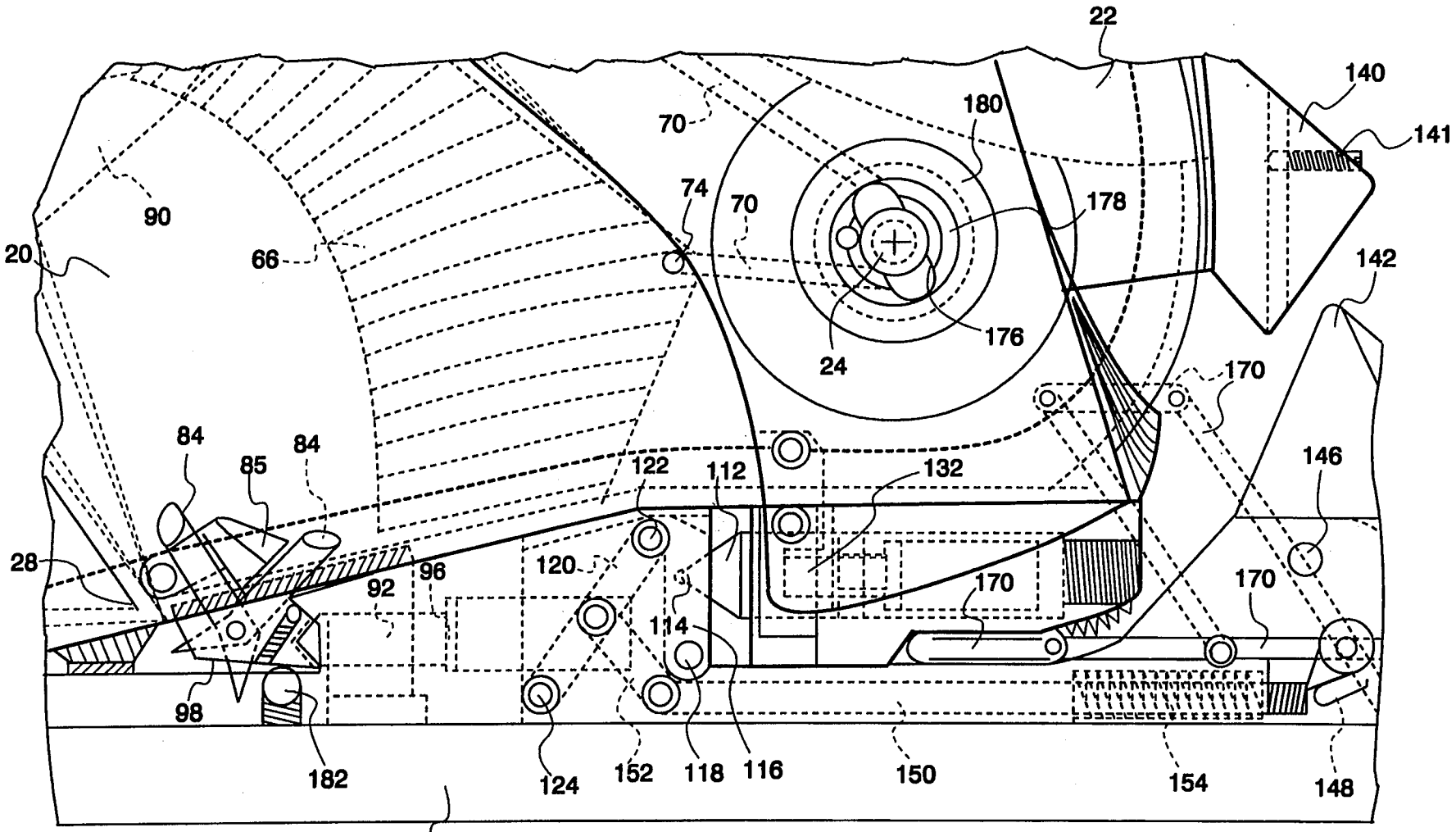

The boot 12 may include additional features to enhance its function and utility. An ice claw 84 (shown in operative and nonoperative positions) may be located in the sole thereof, to aid the skier when walking in the ski boot 12. The ice claw 84 may be locked into the nonoperative position by a latch 85 (FIG. 5), or other appropriate means. In addition, the ski boot may include snaps 86 or a hook-and-loop fastener 88 to secure the skier's pant leg to the boot 12. The forward boot cuff 20 may include a thick internal padding 90 in a conventional fashion for comfort of the wearer. The padding 90 helps absorb and distribute hard forward lean loads of the skier along the shin and forward leg muscles.

The binding 14 includes two primary portions, a first connecting means secured to the ski 16 beneath the boot 12, and a second connected means secured to the boot itself. These primary portions are illustrated in detail in FIG. 1, and are generally similar to identical connecting means illustrated and described in referenced U.S. Pat. Nos. 4,880,251, 5,020,822 and 5,026,087 from which additional detail can be obtained.

The first connecting means comprises a central block 90 appropriately secured to the ski 16. The block 90 has an internal longitudinal bore in which a plunger 92 and spring 94 are located. The spring 94 bears against an enlarged flange 96 on the plunger 92, forcing the plunger forwardly (to the left in FIG. 1) into a socket member 98 located at and in the bottom of the boot 12. The tension of the spring 94 is adjusted by an adjustment screw or other conventional means (not illustrated) in a conventional fashion.

The second connecting means of the binding 14 comprises the socket member 98 as well as a further plunger 100 located in a heel 102 of the boot 12. The plunger 100 is biased forwardly (to the left in FIG. 1) by a pair of springs 104 bearing between plates 106 and 108, the latter plate being fixed to the plunger 100. An adjustment screw 110 is used to shift the plate 106 relative to the plate 108 to change the bearing tension of the springs 104.

The plunger 100 has an extended nose 112 which engages a socket 114 in the block 90. The socket 114 is formed in a hinged socket plate 116 which pivots about a hinge 118 formed in the block 90. The socket plate 116 is maintained in the normal, upright orientation illustrated by means of a toggle 120 secured by a hinge 122 to the socket plate 116 and by a hinge 124 to the block 90.

Springs 126 and 128 may also be located in the heel 102 as shown. Each spring 126 and 128 bears against a respective plunger 130 and 132 which engage notches in a lower portion of the forward cuff 20 to control forward lean in the boot 12, as explained in greater detail in the incorporated patents. Tension of the springs 126 and 128 is controlled in a conventional fashion by adjustment screws or the like 134 and 136.

The hub 34 is encased within a housing 138 appropriately affixed to the rear cuff 22. The housing 138 also stiffens the rear cuff 22. Extending from the bottom of the housing 138 is a cam 140 in registration with a cam follower 142. An adjustment screw 141 is provided in the cam 140 to permit adjustment of any gap between the cam 140 and the cam follower 142. The cam follower is pivotally attached to a block extension 144 of the binding 14 by means of a pin 146. The cam follower 142 extends downwardly, terminating in a curved arm 148. The curved arm 148 bears against a link 150 extending between the arm 148 and a further arm 152 pivotally attached to both the link 150 and the toggle 120. A retraction spring 154 is centered about the link 150 and draws the link 150 to the right, therefore biasing the toggle 120 against the socket plate 116, maintaining the socket plate 116 in the upright orientation illustrated.

When the rear cuff 22 opens as explained above while the ski boot 12 is in the binding 14, the cam 140 engages the cam follower 142. The cam follower, in turn, pivots about the pin 146, forcing the link 150 to the left (FIG. 1), causing the arm 152 to pivot the toggle 120 about the fixed hinge 124, therefore pivoting the socket plate 116 about the hinge 118. This separates the plunger nose 112 from the socket 114, immediately uncoupling the ski boot 12 from the binding 14 and allowing free release of the skier from the ski.

To prevent phantom foot injury, a paddle 156 is mounted on a hinge 158 at the top of the rear cuff 22. The paddle 156, in turn, is connected to a cable 160 extending about a pair of guide pins 162 and 164 to an upstanding arm 166 of a pivotal cam 168. The cam 168 is in registration with the cam follower 142, and depression of the paddle 156 (to the left in FIG. 1) tensions the cable 160, causing the cam 168 to depress the cam follower 142, releasing the ski boot 12 from the binding 14 in precisely the manner which the cam 140 releases the ski boot from the ski. The cam is centered in the operative orientation illustrated by a centering spring 169.

When the ski boot 12 is released from the binding 14 (and therefore from the ski 16), downhill progress of the ski must be stopped. An integral, conventional ski brake 170 may be employed for this purpose. The brake 170 is captured beneath the ski boot 12 when in the binding 14, and is deployed to the position shown in phantom when the ski boot releases.

The binding 14 is a "step-in" type of binding. The block 90 includes a forward extension 172 having a toe entry guide cup 174. The skier enters the binding by first inserting the toe segment 26 in the guide cup 174. The skier then steps down on the block 90, causing the plunger nose 112 to force the hinged socket plate 116 to rotate slightly against the holding force of the retraction spring 154 until the plunger nose 112 engages the socket 114. Once the plunger nose 112 engages the socket 114, the ski boot 12 is firmly engaged on the ski 16 by the binding 14.

The toggle 120 is normally held at one degree past center so that the socket plate 116 is maintained upright and, when the boot 12 is engaged in the binding 14, the plungers and sockets are engaged to retain the boot 12 on the ski 16. Only when the rear cuff 22 opens, or when the paddle 156 is depressed, do the respective cams 140 or 168 engage the cam follower 142 to cause immediate release of the boot 12 from the ski 16. Otherwise, the binding 14 functions as a normal binding, and the plungers 100 and 92 permit release of the boot from the ski in the forward, backward or lateral directions, or a combination of those directions, when the skier falls.

A skier can release the boot 12 when desired by physically depressing the cam follower 142 to cause the release sequence described above. The cam follower 142 is provided with a ski pole tip cup 175 to aid release. The skier simply inserts his ski pole tip in the tip cup 175 and presses down to release.

As illustrated, the central pivot 24 is installed through a slot 176 in a circular pivot disc 178 on either side of the boot 12 installed in a pivot support 180. The slots 176 permit free angulation and lateral flex (to the extent of the slots) of the cuffs 20 and 22 about the pivots 24. To eliminate any flex, the pivots 24, which are screws or the like, can be tightened so that the pivots cannot move in the slots 178. Of course, such tightening does not inhibit forward lean, which is accommodated by the pivot disc 178 in the pivot support 180.

The socket member 98, which is affixed to the bottom of the boot 12, is preferably made of metal. That socket member bears on the binding 14 beneath the boot 12, and in order to substantially eliminate friction between the boot and the binding, one or more ball bearings 182 are installed in the binding 14 directly beneath the socket member 98 as illustrated. The socket member 98 bears on the ball bearings 182, and during lateral release, the ball bearings 182 provide a substantially friction free junction between the boot 12 and the binding 14. Conventional bindings typically utilize soft anti-friction pads, such as Teflon pads, but such soft pads become embedded with dirt and grit, significantly distorting the lateral retention and release values for the binding under most normal skiing conditions. With the use of the steel socket member 98 and the steel ball bearings 182, however, that friction problem is eliminated.

FIGS. 6–9 illustrate modification of a boot according to the invention to utilize the boot release feature of the invention in a conventional ski binding. In FIGS. 6–9, the rear cuff release, designated generally at 204, is as described in incorporated U.S. Pat. Nos. 4,880,251, 5,020,822 and 5,026,087 to which one may refer for greater detail. Alternatively, the release mechanisms of FIGS. 1–5 could be employed instead.

Figure 6:
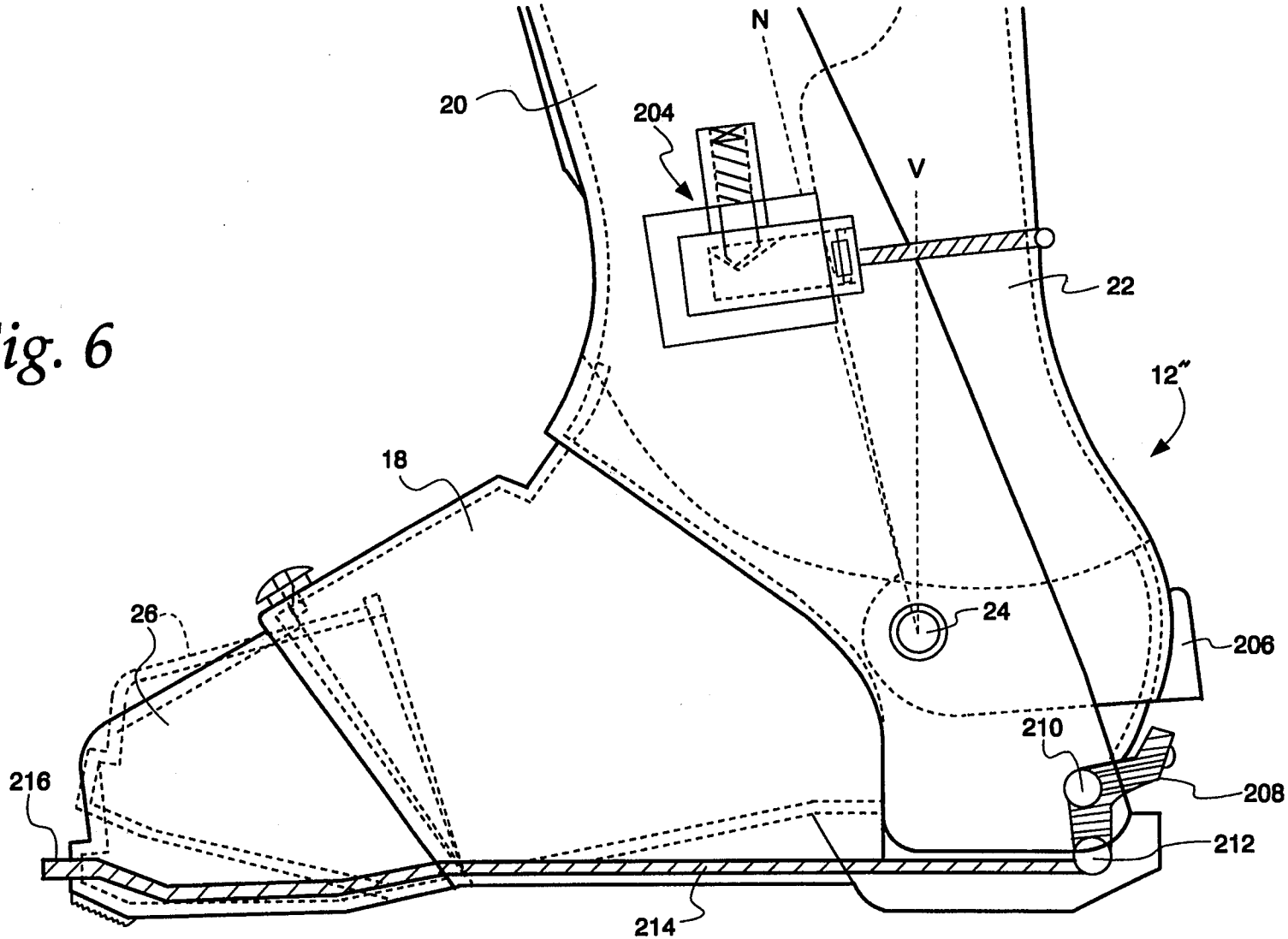
FIG. 6 is a side elevational illustration of a ski boot according to the invention, showing one means of causing uncoupling of the boot from a conventional ski binding.

In FIG. 6, a cam 206 is secured to the rear cuff 22, in registration with a pivotal cam follower 208 secured to the foot shell 18 about a pivot 210. The cam follower 208 is secured through a pivot 212 to a link 214 extending through the sole of the boot 12" and terminating at an actuation end 216 The actuation end 216 may, in turn, engage the toe piece of a conventional heel-and-toe binding so that when the rear cuff 22 is released and the cam 206 strikes the cam follower 208, the actuation end 216 may cause disengagement of the boot 12" from the binding toe piece.

Figure 7:
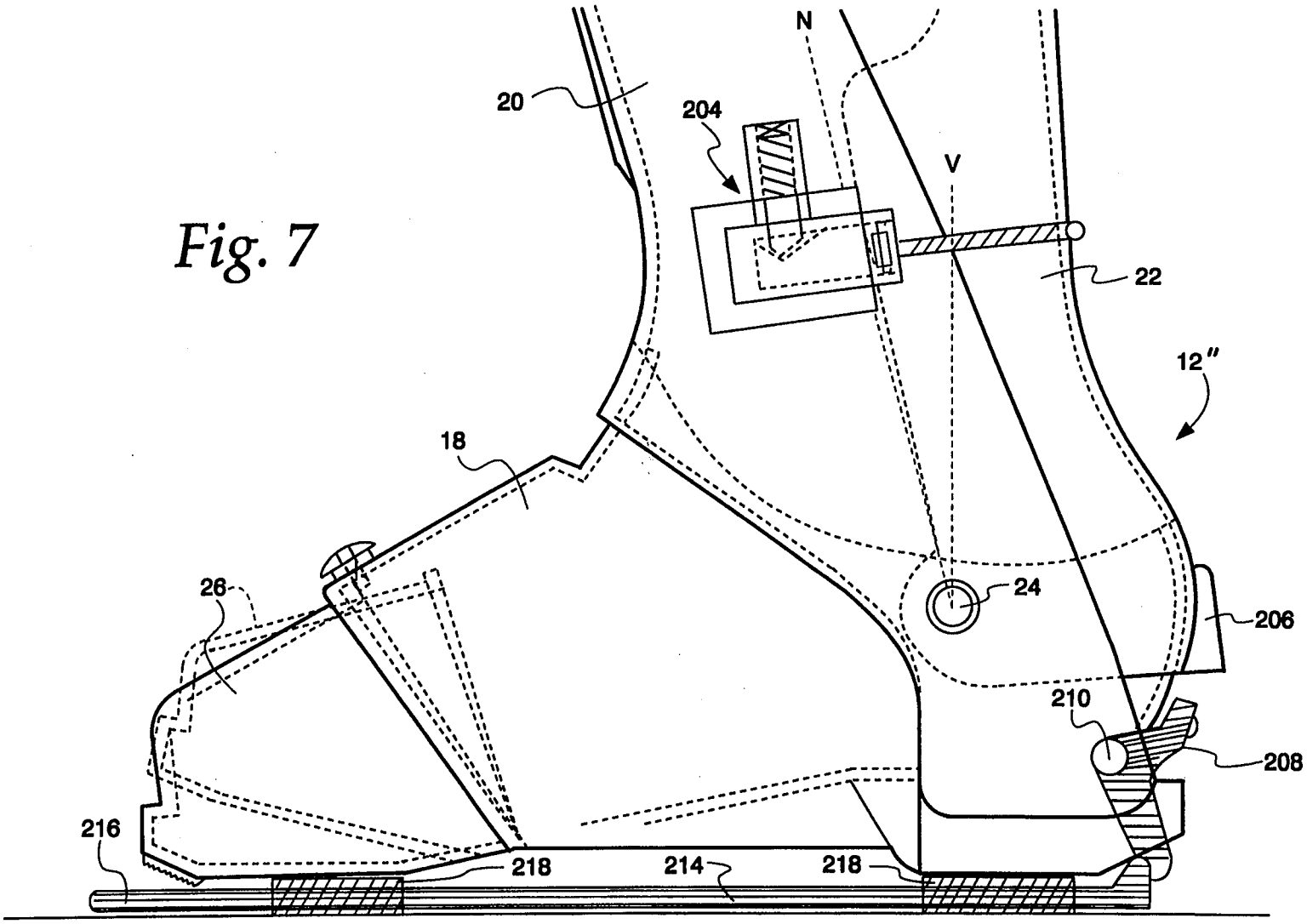
FIG. 7 is a side elevational view similar to FIG. 6, but showing another means of causing uncoupling from a conventional ski binding.

FIG. 7 is similar to FIG. 6, in that the boot 12" includes a cam 206 aligned with a cam follower 208. In this form of the invention, however, the link 214 is not connected to the cam follower 208, but rather is mounted in portions 218 of the binding located beneath the boot 12". The link 214 includes an actuation end 216 and performs in the same manner as described in relation to FIG. 6, releasing the boot 12" from a conventional binding toe (not illustrated) when the rear cuff 22 has been released from the forward cuff 20.

Figure 8:
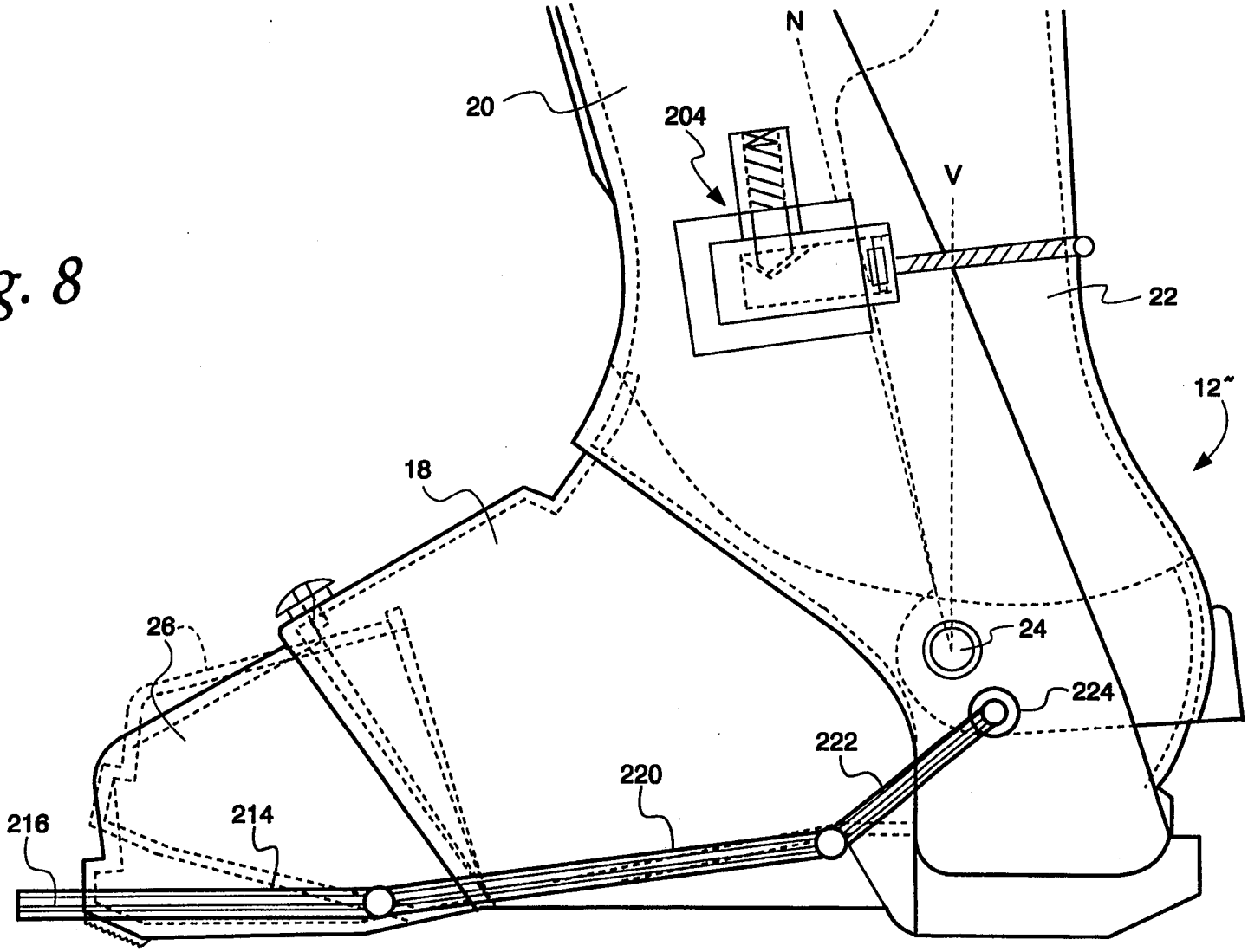
FIG. 8 is a side elevational view similar to FIG. 6, but illustrating a further means of causing uncoupling of the ski boot from a conventional binding.

FIG. 8 illustrates a form of the invention quite similar to FIGS. 6 and 7, in that it employs a link 214 having an actuation end 216. In this form of the invention, however, the link 214, which passes through the sole of the boot 12" is connected to a link 220 which, in turn, is connected to a link 222 secured directly to the rear cuff 22 through an aperture 224 in the forward cuff 22. The links 214, 220 and 222 may be connected together as appropriate to translate opening of the rear cuff 22 to the actuation end 216 to disengage the boot 12" from the front toe piece (not illustrated) of a conventional heel-and-toe binding.

Figure 9:
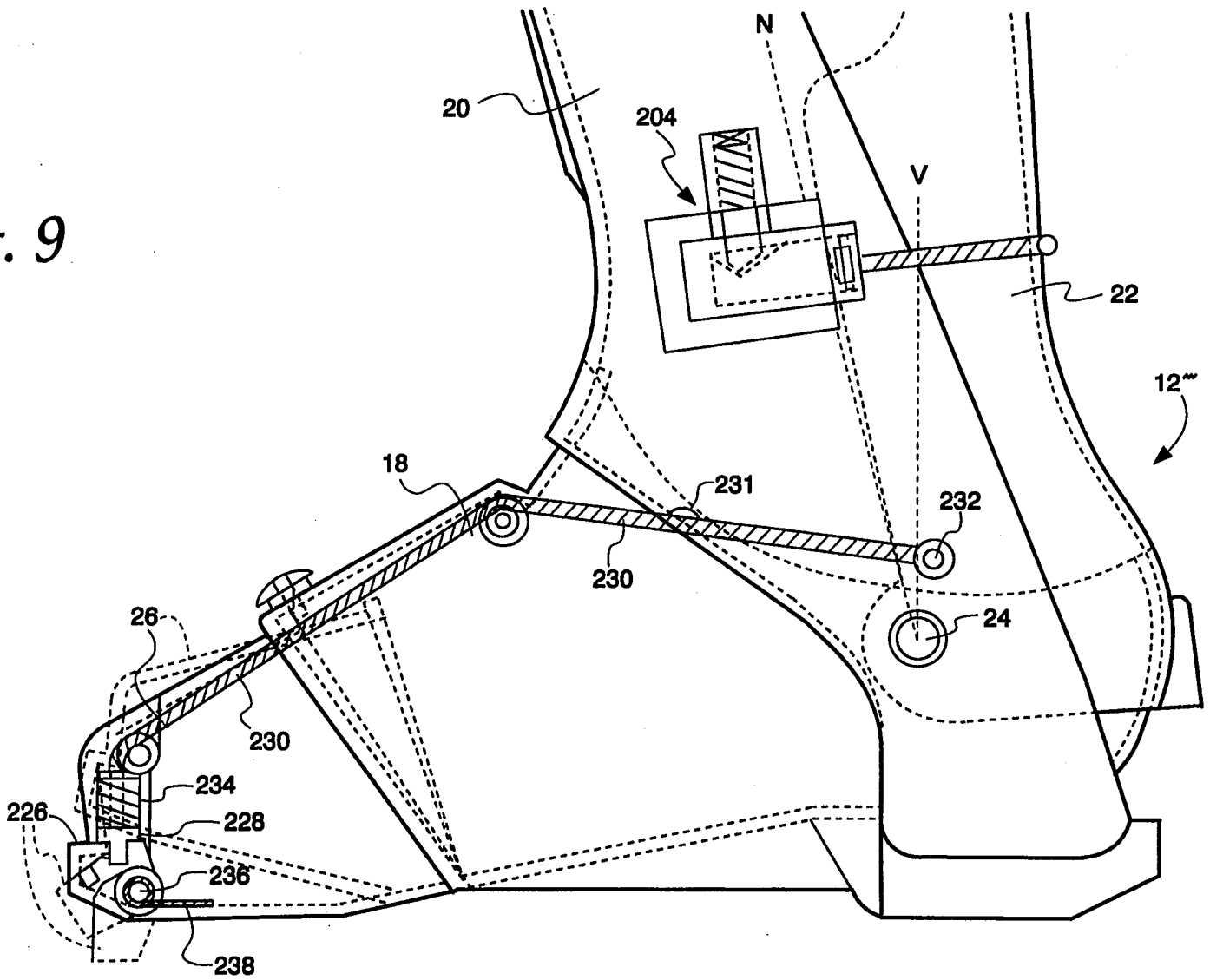
FIG. 9 is a side elevational view similar to FIG. 6, and showing yet another means for causing uncoupling of the ski boot from a conventional ski binding.

FIG. 9 also permits release of the ski boot 12" from a conventional heel-and-toe binding (not illustrated). In this form of the invention, the boot 12" has a pivotal toe piece 226 normally held in place by a spring loaded plunger 228. A cable 230 is connected to the plunger 228, and extends through notch 231 in the foot shell 18 to a connection point 232 on the rear cuff 22. When the rear cuff 22 is released from the forward cuff 20, the cable 230 draws the plunger 228 upwardly against the force of a spring 234, releasing the toe piece 226 and allowing the toe piece to pivot about a hinge 236. Therefore, the boot 12" is immediately released from the conventional binding toe piece. A return spring 238 may be employed about the hinge 236 to return the toe piece 226 to the normal orientation shown in bold fashion in FIG. 9 after release.

Figure 10:
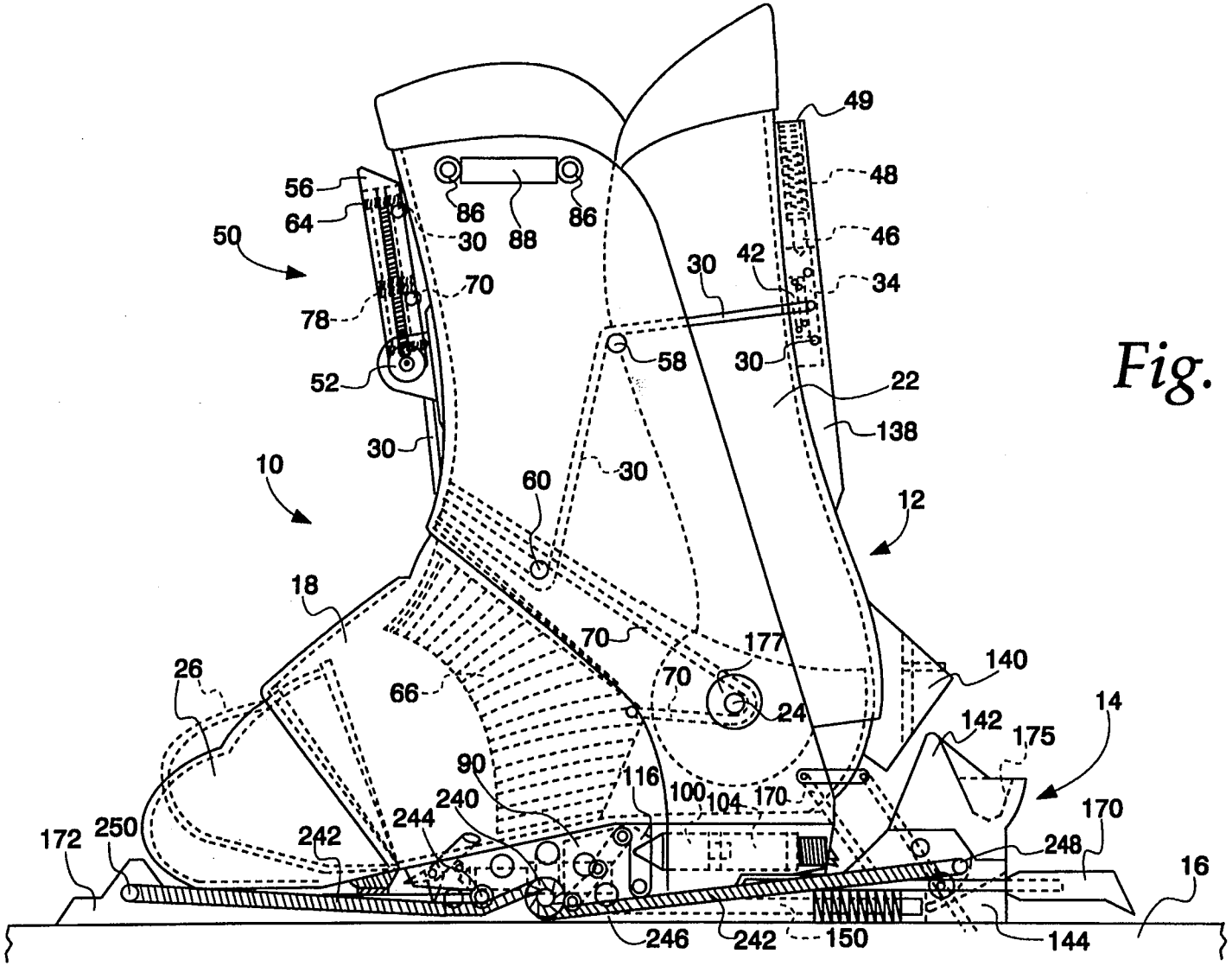
FIG. 10 is a side elevational illustration of the invention with portions removed for clarity and including means in the binding for stiffening the ski beneath the ski boot.

FIG. 10 illustrates yet another form of the invention, showing generally the boot-binding arrangement of FIGS. 1–4, but eliminating, for purposes of clarity, the phantom foot release paddle 156 and its associated linkage to the cam 168, and also the reinforcement member 54 surrounding the pivotal closure lever 50. Otherwise, the arrangement illustrated is identical.

In this form of the invention, a flex control is incorporated in the binding 14 to stiffen or soften the flex of the ski 16 beneath the binding 14. To this end, a three position lever 240 is mounted on the outside of the block 90 beneath the ski boot 12. A cable 242 extends from the lever 240 about cable rollers 244 and 246. The cable 242 is unitary, a rear portion extending through an aperture 248 in the block 144 and joining on the opposite side from that shown a forward portion 242 which passes through an aperture 250 in the block 172.

The lever 240 is positioned in three positions, numbered 1, 2 and 3 in FIG. 10. In position 1, the cable 242 is most relaxed, therefore providing the most flex of the ski 16 beneath the binding 14. The softest flex is normally for skiing softer snow, such as freshly fallen snow. In position 2, however, the cable 242 is tensioned somewhat through the blocks 144 and 172, stiffening the ski 16 beneath the binding 14. In position 3, the lever 240 is in its farthest excursion, tensioning the cable 242 to the greatest extent. This, in turn, stiffens the ski 16 beneath the binding 14, a stiff ski normally being used to ski harder snow or ice.

FIGS. 11–14 illustrate one means of providing internally a cant for the boot-binding arrangement of the invention, and providing a true cant where the ski boot is canted relative to the ski, rather than, as in conventional ski boots, canting only the boot cuff relative to the boot sole.

Canting is provided by a pair of tiltable base plates 252 and 254 located in the block 90. The base plate 252 is held in place by a pair of screws 256 which pass into the ski 16. Opposite ends of the base plate 252 are located above a pair of opposite elongated channels 258 in opposite sides of the block 90.

A cam 260 is located in each of the channels 258. Each cam 260 includes a camming surface 262 extending beneath an opposite end of the base plate 252. The other end of each of the cams 260 terminate in a rack 264. A pinion 266 engages each rack 264, and is driven by a shaft 268. The shafts 268, in turn, are capped with bevel gears 270 which are engaged by a bevel gear 272 on a shaft 274. The shaft 274 extends to an adjustment knob 276.

The base plate 254 is similar in nature to the base plate 252. The base plate 254, which carries the ball bearings 182, is held in place by a screw 278 passing into the ski 16. Opposite ends of the base plate 254 extend above channels 280 formed in the block 90. A cam 282 is located in each of the channels 280, each cam 282 having a camming surface 284 extending beneath an opposite end of the base plate 254. The opposite ends of the cams 282 are formed with racks 286 engaged by pinions 288 mounted on shafts 290. The shafts 290 are capped by bevel gears 292 engaged by a further bevel gear 294 mounted on a shaft 296. The shaft 296 extends to an adjustment knob (not illustrated) which is identical to the adjustment knob 276.

Figure 14:
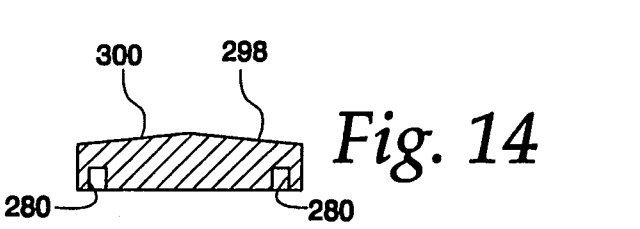
FIG. 14 is a cross-sectional illustration taken along lines 14—14 of FIG. 11.
Figure 13:
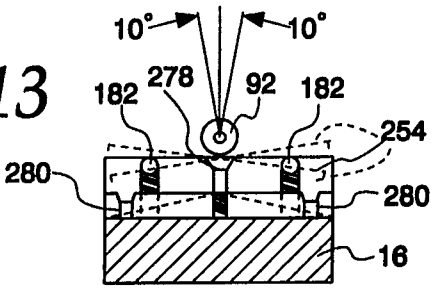
FIG. 13 is a cross-sectional illustration taken along lines 13—13 of FIG. 11, and also showing a cross-section of the ski.
Figure 12:
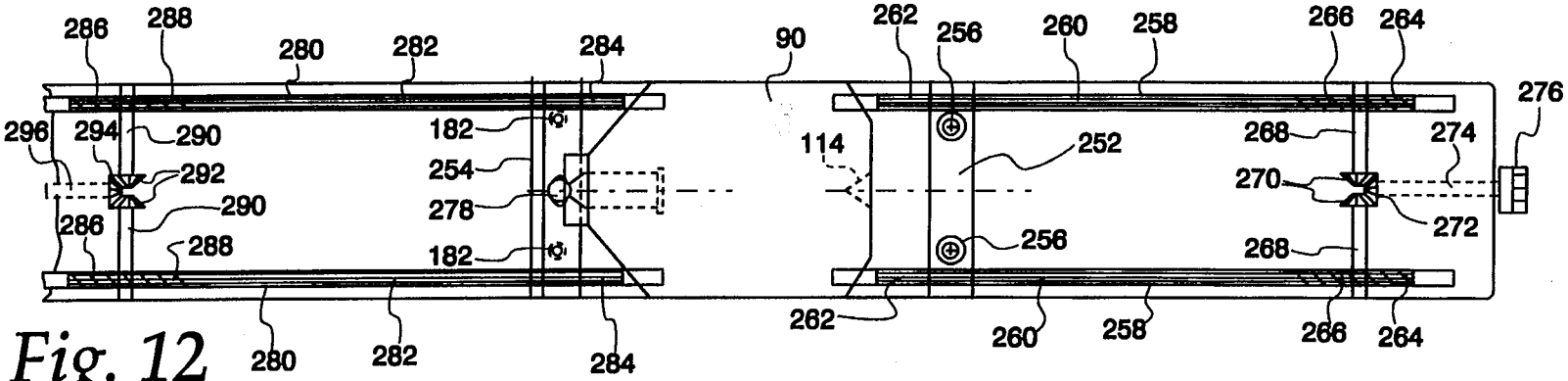
FIG. 12 is a top plan view of FIG. 11, with the ski boot heel omitted and with portions of the binding being broken away to illustrate detail.
Figure 11:
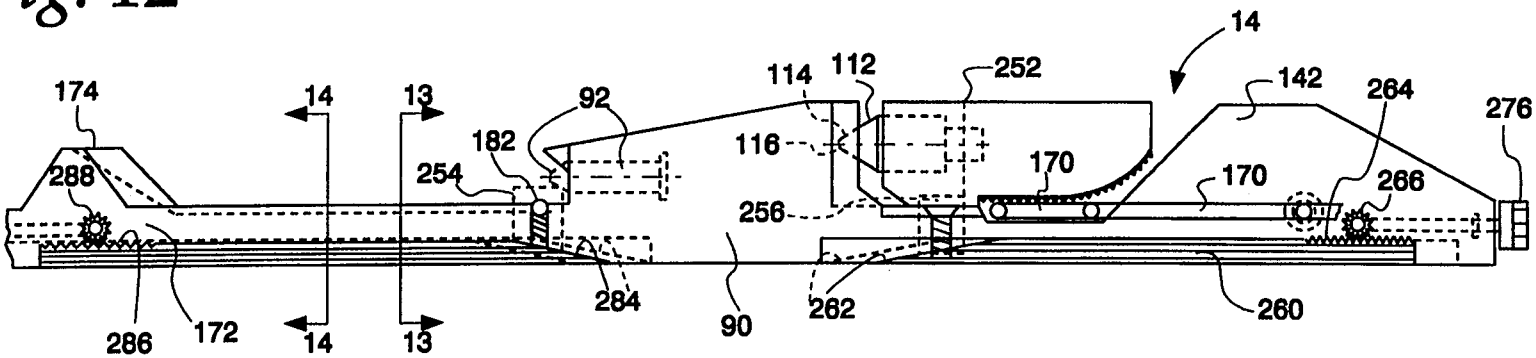
FIG. 11 is a side elevational illustration of the binding portion of the invention, also showing the heel of the ski boot, and being somewhat-simplified and with portions omitted for purposes of clarification of explanation.

Because the ski boot is canted relative to the ski and therefore relative to the block 90, in order to accommodate canting, the forward portion of the block 90 is sloped on opposite sides of its center line, as shown in FIG. 14 by the opposite slopes 298 and 300. The sloping of the slopes 298 and 300 need only be as great as the maximum amount of tilting permitted for the base plate 254. The maximum amount illustrated in FIG. 13 is 10° in either direction about the center line of the plunger 92, and therefore the slopes 298 and 300 extend at a maximum of 10°.

Canting is accomplished by loosening the screws 256 and 278 to free the base plates 252 and 254. Then, by judicious rotation of the knob 176 (and its counterpart connected to the shaft 296), the two shafts 268 are rotated in opposite directions and the two shafts 290 are rotated in opposite directions, sliding the two cams 260 in directions opposite to one another and the two cams 282 in directions opposite to one another, tilting the base plates 252 and 254 in the directions dictated by movement of the respecting camming surfaces 262 and 284.

The boot and binding arrangement according to the invention provides a significant improvement in skier safety. Not only will the invention largely protect the skier against anterior cruciate ligament injuries, but also the invention protects a skier against phantom foot injury, as well. It will be evident from the foregoing description of the various forms of the invention that the invention may take other physical forms as well. Various changes may be made to the invention without departing from the spirit thereof or scope of the following claims.

What is claimed is:

1. A ski boot for attachment to a ski, comprising a. a foot shell shaped to encompass at least a portion of a foot when the ski boot is worn, b. a forward cuff and a hinged rear cuff attached to said foot shell, c. means for releasably securing said rear cuff to said forward cuff, said securing means further including means responsive to rearward pressure on said rear cuff for releasing said rear cuff so that under predetermined rearwardly-directed load on said rear cuff said rear cuff will separate from said forward cuff to permit free movement of said rear cuff, and d. closing means mounted on said forward cuff, said closing means including a vertically repositionable closure lever on said forward cuff, said closure lever being positionable in a first orientation for engaging said rear cuff with said forward cuff and being positionable in a second orientation to disengage said rear cuff from said forward cuff.

2. A ski boot according to claim 3 in which said cable comprises part of said closing means.

3. A ski boot according to claim 1 in which said means for releasably securing includes at least one cable connected to said closing means.

4. A ski boot according to claim 3 in which said means for releasing comprises a cable end grip and a spring loaded plunger engaging said cable and grip.

5. A ski boot according to claim 4 in which said cable end grip comprises a rotatable hub having at least one circumferential notch therein, said plunger engaging said notch.

6. A ski boot according to claim 5 including means for automatically re-engaging said plunger and said notch when disengaged.

7. A ski boot according to claim 6 in which said means for automatically re-engaging comprises a recoil spring secured to said hub.

8. A ski boot according to claim 3 in which said closure lever is pivotal.

9. A ski boot according to claim 8 including means for adjusting attachment of said cable to said closure lever.

10. A ski boot according to claim 9 in which said means for adjusting attachment comprises a cable clamp mounted for axial advancement on a guide.

11. A ski boot according to claim 1 including a foot-enveloping foot positioning device in the ski boot for holding a foot in a desired location in the ski boot, and including means for adjusting the location of said foot positioning device.

12. A ski boot-according to claim 11 in which said means for adjusting the location comprises a pair of cables attached to opposite sides of said foot positioning device and connected to said closing means for drawing said foot positioning device toward a heel area of the ski boot when said closing means is in said first orientation.

13. A ski boot according to claim 1 including means extending from said rear cuff for engaging a ski binding to initiate disengagement of the ski boot from the ski binding upon separation of said rear cuff from said forward cuff.

14. A ski boot according to claim 13 in which said means for engaging comprises a cam.

15. A ski boot according to claim 1 including means for controlling forward flexure of said forward cuff.

16. A ski boot according to claim 15 in which said means for controlling comprises a reinforcement member extending along a forward face of said forward cuff, said reinforcement member having at least one longitudinal bore, and including a flex control rod shaped to be engaged in each said bore.

17. A ski boot according to claim 1 in which said foot shell includes unattached first and second shell segments secured to a sole in a fore-and-aft relationship with one of said shell segments overlapping the other of said shell segments at approximately the location of the ball of a foot when within the boot, forming a discontinuity in said foot shell at the overlapping of said segments, thereby forming a living hinge in said sole in the vicinity of the overlapping of said shell segments.

18. A ski boot according to claim 17 in which one of said shell segments comprises a toe segment overlapped by the other of said segments, and in which said toe segment has a fixed radius about said living hinge.

19. A ski boot according to claim 1 including means for lateral flexure of said cuffs relative to said foot shell.

20. A ski boot according to claim 19 in which said lateral flexure means comprises opposite slots in said cuffs, and a central pivot for hinging of said cuffs extending from said foot shell into each said slot.

* * * * *